US012799757B2

(12) United States Patent
Besnier et al.

(10) Patent No.: US 12,799,757 B2
(45) Date of Patent: Nov. 17, 2026

(54) POOL EQUIPMENT WITH WATER-FILLED CAVITY

(71) Applicant: ZODIAC POOL CARE EUROPE, Belberaud (FR)

(72) Inventors: Arnaud Besnier, Beaupuy (FR); Quentin Lutrand, Belberaud (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 398 days.

(21) Appl. No.: 18/236,659

(22) Filed: Aug. 22, 2023

(65) Prior Publication Data

US 2024/0068257 A1 Feb. 29, 2024

Related U.S. Application Data

(60) Provisional application No. 63/401,417, filed on Aug. 26, 2022.

(51) Int. Cl.
*E04H 4/16* (2006.01)
*E04H 4/12* (2006.01)

(52) U.S. Cl.
CPC ..... *E04H 4/1654* (2013.01); *E04H 4/1281* (2013.01)

(58) Field of Classification Search
CPC ... E04H 4/1654; E04H 4/1281; E04H 4/1663; E04H 4/1672
See application file for complete search history.

(56) References Cited

U.S. PATENT DOCUMENTS

| | | | | |
|---|---|---|---|---|
| 8,578,538 | B2 | 11/2013 | Moore et al. | |
| 9,488,154 | B2 | 11/2016 | van der Meijden | |
| 10,316,534 | B2 | 6/2019 | Michelon et al. | |
| 10,519,682 | B2 | 12/2019 | Schloss et al. | |
| 2014/0076789 | A1* | 3/2014 | Shlomi-Shlomi | E04H 4/1209 901/44 |
| 2014/0303810 | A1 | 10/2014 | van der Meijden et al. | |
| 2016/0207204 | A1* | 7/2016 | Teuscher | G05D 1/0259 |
| 2017/0303754 | A1* | 10/2017 | Conrad | A47L 9/2873 |
| 2018/0328059 | A1* | 11/2018 | Hayes | E04H 4/1654 |

(Continued)

FOREIGN PATENT DOCUMENTS

| | | | |
|---|---|---|---|
| EP | 3205793 | A1 | 8/2017 |
| GB | 1565607 | A | 4/1980 |

(Continued)

OTHER PUBLICATIONS

Australian Application No. 2023331229, Notification of Material Filed by a Third Party mailed on Mar. 5, 2025, 2 pages.

(Continued)

*Primary Examiner* — Andrew A Horton
(74) *Attorney, Agent, or Firm* — Kilpatrick Townsend & Stockton LLP

(57) ABSTRACT

Pool equipment for a swimming pool or spa may include a sealable cavity, and the sealable cavity may allow a flow of water through the cavity and maintain the cavity with water when the flow of water is disrupted or halted. Optionally, a probe and/or a water treatment feature may be within the cavity. The cavity may be within a body cavity defined by a body of the pool equipment or outside of the body cavity.

18 Claims, 1 Drawing Sheet

(56) References Cited

U.S. PATENT DOCUMENTS

2019/0360226 A1 11/2019 Schloss

FOREIGN PATENT DOCUMENTS

WO WO-2006125247 A1 * 12/2006 ..... E04H 4/1209
WO 2017046808 A1 3/2017

OTHER PUBLICATIONS

International Application No. PCT/IB2023/058361, International Preliminary Report on Patentability mailed on Mar. 13, 2025, 9 pages.
International Application No. PCT/IB2023/058361, International Search Report and Written Opinion mailed on Nov. 28, 2023, 16 pages.

* cited by examiner

POOL EQUIPMENT WITH WATER-FILLED CAVITY

REFERENCE TO RELATED APPLICATION

This application claims the benefit of U.S. Provisional Patent Application No. 63/401,417, filed on Aug. 26, 2022, and entitled POOL EQUIPMENT WITH WATER-FILLED CAVITY, the content of which is hereby incorporated by reference in its entirety.

FIELD OF THE INVENTION

The invention relates to systems and apparatuses for cleaning water-containing vessels such as swimming pools and spas and more particularly, although not necessarily exclusively, to pool equipment such as but not limited to automatic swimming pool cleaners (APCs).

BACKGROUND OF THE INVENTION

Numerous cleaning devices capable of autonomous movement within swimming pools and spas currently exist. The most common of these devices are APCs, which often are either hydraulic or robotic in type. Hydraulic cleaners vary water flow for movement, while robotic cleaners typically employ electric motors to cause motion. Hydraulic APCs, furthermore, subdivide into "pressure-side" and "suction-side" cleaners, with pressure-side cleaners being fluidly connected to outputs of pumps of pool water circulation systems and suction-side cleaners being fluidly connected to inputs of such pumps.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, an APC for a swimming pool or spa includes a cavity for retaining water when the APC is removed from the swimming pool or spa.

According to various embodiments, an APC for a swimming pool or spa includes a sealable cavity for (i) maintaining the cavity with water when the APC is removed from the swimming pool or spa and (ii) allowing a flow of water through the cavity when the APC is immersed in the swimming pool or spa.

According to some embodiments, an APC for a swimming pool or spa may maintain a wet probe while (i) immersed in the swimming pool or spa and (ii) removed from the swimming pool or spa.

According to various embodiments, an APC for a swimming pool or spa may maintain a water treatment feature within a wet cavity while (i) immersed in the swimming pool or spa and (ii) removed from the swimming pool or spa.

According to certain embodiments, pool equipment for a swimming pool or spa may include a cavity for retaining water when a flow of water through the pool equipment is disrupted and/or halted.

According to some embodiments, pool equipment for a swimming pool or spa includes a sealable cavity for (i) allowing a flow of water through the cavity and (ii) maintaining the cavity with water when the flow of water is disrupted or halted.

According to various embodiments, pool equipment for a swimming pool or spa may maintain a wet probe when a flow of water through the pool equipment is disrupted or halted.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different figures is intended to illustrate like or analogous components.

DESCRIPTION OF THE INVENTION

Figure 1:
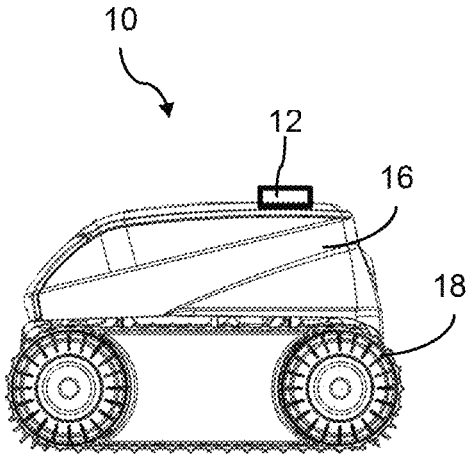
FIG. 1 illustrates a pool equipment for a swimming pool or spa according to embodiments.

Described herein are pool equipment for swimming pools or spas that maintain a cavity full of water. Such pool equipment includes, but is not limited to, APCs, heat pumps, and/or other pool equipment as desired. In certain embodiments, the pool equipment maintains the cavity full of water when the flow of water through the pool equipment is disrupted and/or halted. In one non-limiting example, the pool equipment is an APC that maintains a cavity full of water when removing the APC from a swimming pool or spa and allow a flow of water through the cavity when the APC is immersed in the swimming pool or spa. In some embodiments, the cavity may allow for a flow of "fresh" water from the pool through the cavity when the APC is at least partially submerged and/or cleaning the pool. In certain embodiments, the cavity is selectively sealable such that water may flow through the cavity while the APC is immersed but water is maintained within the cavity when the APC is removed from the swimming pool. The cavity may be a cavity of the APC (and/or other pool equipment) and/or may be part of a sub-system that is detachable from the APC (and/or other pool equipment).

Some features or components of pool equipment such as heat pumps and APCs may need to be permanently wet to be operational, and pool equipment with the cavity described herein allow for such features or components to be maintained in a wet state. As a non-limiting example, a water sensing probe may need to be permanently wet to be operational, and the pool equipment described herein may receive the probe within the cavity and keep the probe wet. As an example, the pool equipment is an APC, and the probe within the cavity may be kept when removing the APC from the swimming pool while also allowing the probe to sense water when the APC is immersed. As another non-limiting example, a water treatment feature such as but not limited to a chemical tablet (e.g., a chlorine tablet) may be provided within the cavity, thereby allowing the APC (and/or other pool equipment) to manage a chemical level (e.g., chlorine level) within the pool by diffusing the chemical (e.g., chlorine) into the pool when the APC is immersed. In certain embodiments, the cavity described herein optionally uses pump overpressure to drive clean fluid (e.g., downstream from a filter of the APC) into the cavity and to push the old fluid outside the cavity. In various embodiments, a conduit (flexible conduit, rigid conduit, etc.) may fluidly connect the cavity with the pump (or other portion of the APC as desired), thereby allowing the cavity to be provided at any location on the APC and/or pool equipment as desired such as within a body cavity defined by a body of the APC and/or pool equipment, within a cover cavity defined by a cover of the APC and/or pool equipment, external to the body of the APC and/or pool equipment, etc. Various other benefits and advantages may be realized with the devices and methods provided herein, and the aforementioned advantages should not be considered limiting.

Figure 2:
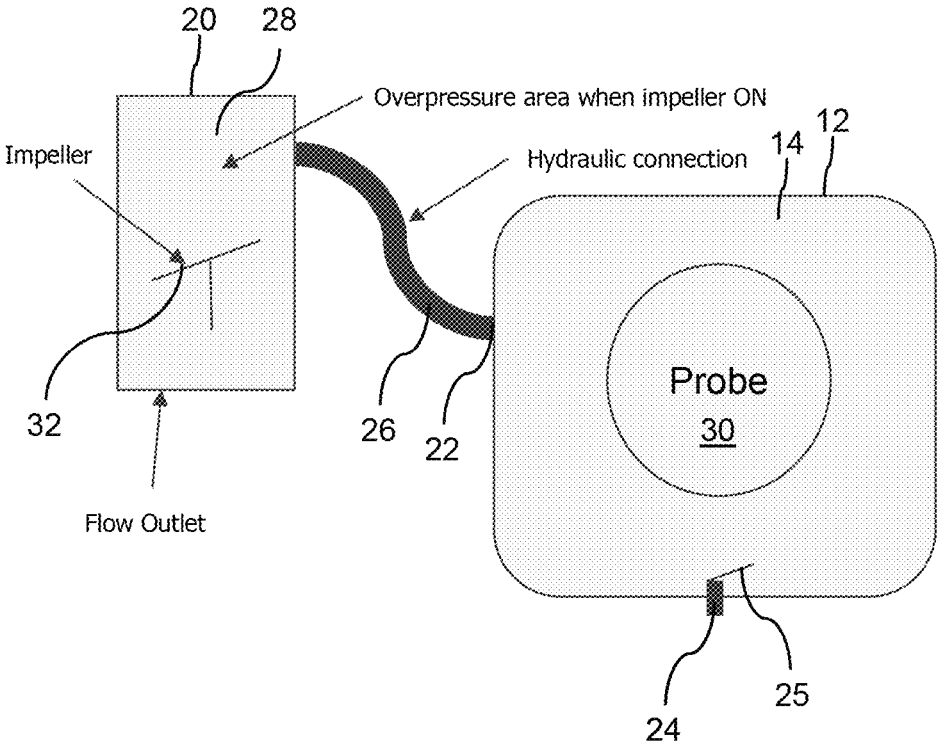
FIG. 2 illustrates a portion of the pool equipment of FIG. 1 according to embodiments.

FIGS. 1 and 2 illustrate an example of pool equipment with a cavity 14 according to embodiments. In the embodiment illustrated, the pool equipment is an APC 10 with a container 12 defining a cavity 14 (see FIG. 2) according to embodiments; however, in other embodiments, the pool equipment may be other types of pool equipment with water cavities, including but not limited to heater pumps. As such, while the following description makes reference to the cavity 14 in the context of the APC 10, the description is applicable to any pool equipment with a cavity 14.

The APC 10 generally includes a body 16 and one or more motive elements 18 (e.g., wheels, tracks, feet, etc.). A pump 20 (see FIG. 2), filter assembly, cleaning device such as a brush assembly or other suitable device, any suitable electric or other motors, a controller (e.g., processor and memory), a communication module, an on-board power source (e.g., rechargeable batteries), and/or various other features may be provided on or within the APC 10 as desired. The APC 10 may be various types of APCs as desired, and the particular APC 10 illustrated should not be considered limiting. Other non-limiting examples of APCs 10 may include those described in U.S. Pat. Nos. 10,316,534, 9,488,154, 8,578,538, and U.S. Patent Publication No. 2014/0303810, all of which are hereby incorporated by reference in their entireties. In some cases, the APC need not be a robotic APC and thus may not have an on-board power source.

Referring to FIG. 2, in various embodiments, the container 12 defines the cavity 14. While the container 12 is illustrated as defining the cavity 14, additionally, or alternatively, in other embodiments, the cavity 14 may be a component of a sub-system that is detachable from the APC 10. As an example, the cavity 14 may be defined by a water-sensing container or structure that is detachable from the APC 10 as desired.

The container 12 includes an inlet 22 and an outlet 24 for the cavity 14. Optionally, the inlet 22 and/or the outlet 24 may include a flow control mechanism such as but not limited to a check valve 25. While the check valve 25 is illustrated at the outlet 24 in FIG. 2, it need not be in other embodiments, and/or the check valve 25 may be provided for controlling flow through the inlet 22. Moreover, the particular check valve 25 illustrated should not be considered limiting. The inlet 22 may be fluidly connected to a flow path of water through the APC 10 via conduit 26. In some embodiments, the conduit 26 is a flexible conduit, and the container 12 may be provided at any location on and/or within the APC 10 as desired. In other embodiments, the conduit need not be flexible and instead may be any type of conduit as desired, including plastic conduit, rigid conduit, etc. As such, the particular location of the container 12 illustrated in FIG. 1 should not be considered limiting.

In the embodiment illustrated, the inlet 22 is in fluid communication with the pump 20 of the APC 10, and in particular is in fluid communication with an overpressure area 28 of the pump 20 (e.g., downstream from filtration of the APC 10 and over an impeller 32). In this embodiment, pump overpressure may be used to drive water through the conduit 26 and into the cavity 14 while also forcing water within the cavity 14 out the outlet 24 when the pump 20 is operational and/or the APC 10 is submerged. In other embodiments, the cavity 14 may be fluidly connected to other regions or areas of the APC 10 as desired such that water flows into and through the cavity 14 when the APC 10 is immersed and/or operational within the water of the swimming pool.

In various embodiments, when the APC 10 is removed from the swimming pool, the inlet 22 and the outlet 24 may self-seal (e.g., due to water surface tension and/or water pressure force) to minimize and/or prevent water from escaping the cavity 14. Optionally, a flow controller such as but not limited to the check valve 25 may be provided with the inlet 22 and/or the outlet 24 to further secure the inlet 22 and/or the outlet 24 and minimize leakage from the cavity 14.

In this way, the APC 10 may maintain water within the cavity 14 both when the APC 10 is removed from the swimming pool and when the APC 10 is immersed. The APC 10 with the water-filled cavity 14 may be used for various features or components of the APC 10 as desired.

In the embodiment illustrated in FIG. 2, a probe 30, such as but not limited to a water sensing probe, is provided within the cavity 14 and maintained in a wet state such that the probe 30 remains operational. In the embodiment where the probe 30 is the water-sensing probe, the probe 30 may sense water based on a flow of "new" water into the cavity 14 (e.g., due to the APC 10 being immersed in water and/or the APC 10 being operational within the pool).

In another embodiment, the cavity 14 may contain a water treatment feature such as but not limited to a chemical tablet, such as but not limited to a chlorine tablet. In this embodiment, the chemical and/or chlorine tablet may be maintained in a wet state, and chlorine may diffuse into the pool based on water flowing into and through the cavity 14 due to the cavity 14 being immersed and/or the APC 10 being operational within the pool.

The aforementioned examples of features provided within the water-filled cavity 14 are for illustrative purposes only and should not be considered limiting, and in other embodiments, other types of features may be provided within the cavity 14 as desired.

Exemplary concepts or combinations of features of the invention may include:

A. An APC for a swimming pool or spa, the APC comprising a cavity for retaining water when the APC is removed from the swimming pool or spa.

B. The APC according to any previous or subsequent statement or combination of statements, further comprising a probe within the cavity.

C. The APC according to any previous or subsequent statement or combination of statements, further comprising a water treatment feature within the cavity.

D. The APC according to any previous or subsequent statement or combination of statements, wherein the water treatment feature comprises a chlorine tablet.

E. The APC according to any previous or subsequent statement or combination of statements, wherein the cavity is within a body cavity defined by a body of the APC or outside of the body cavity.

F. An APC for a swimming pool or spa, the APC comprising a sealable cavity configured to (i) maintain the cavity with water when the APC is removed from the swimming pool or spa and (ii) allow a flow of water through the cavity when the APC is immersed in the swimming pool or spa.

G. The APC according to any previous or subsequent statement or combination of statements, wherein the sealable cavity comprises an inlet and an outlet, and wherein the APC further comprises a check valve for at least one of the inlet or the outlet.

H. The APC according to any previous or subsequent statement or combination of statements, wherein the sealable cavity is self-sealing.

I. The APC according to any previous or subsequent statement or combination of statements, wherein the cavity is detachable from a body of the APC.

J. An APC for a swimming pool or spa, the APC configured to maintain a wet probe while (i) immersed in the swimming pool or spa and (ii) removed from the swimming pool or spa.

K. An APC for a swimming pool or spa, the APC configured to maintain a water treatment feature within a wet cavity while (i) immersed in the swimming pool or spa and (ii) removed from the swimming pool or spa.

L. Pool equipment for a swimming pool or spa, the pool equipment comprising a cavity for retaining water when a flow of water through the pool equipment is disrupted and/or halted.

M. The pool equipment according to any previous or subsequent statement or combination of statements, wherein the pool equipment comprises a heater pump or an APC.

N. Pool equipment for a swimming pool or spa, the pool equipment comprising a sealable cavity configured to (i) allow a flow of water through the cavity and (ii) maintain the cavity with water when the flow of water is disrupted or halted.

O. The pool equipment according to any previous or subsequent statement or combination of statements, wherein the pool equipment comprises a heater pump or an APC.

P. The pool equipment according to any previous or subsequent statement or combination of statements, wherein the pool equipment comprises a heater pump.

Q. The pool equipment according to any previous or subsequent statement or combination of statements, wherein the pool equipment comprises APC.

R. The pool equipment according to any previous or subsequent statement or combination of statements, wherein the sealable cavity is configured to allow the flow of water through the cavity when the APC is immersed in the swimming pool or spa and to maintain the cavity with water when the APC is removed from the swimming pool or spa.

S. The pool equipment according to any previous or subsequent statement or combination of statements, wherein the APC comprises a pump, and wherein the sealable cavity is in fluid communication with the pump.

T. The pool equipment according to any previous or subsequent statement or combination of statements, wherein the sealable cavity is within a body cavity defined by a body of the pool equipment or outside of the body cavity.

U. The pool equipment according to any previous or subsequent statement or combination of statements, wherein the sealable cavity comprises an inlet and an outlet, and wherein the pool equipment further comprises a check valve for at least one of the inlet or the outlet.

V. The pool equipment according to any previous or subsequent statement or combination of statements, further comprising a probe within the cavity.

W. Pool equipment for a swimming pool or spa, the pool equipment configured to maintain a wet probe when a flow of water through the pool equipment is disrupted or halted.

X. The pool equipment according to any previous or subsequent statement or combination of statements, wherein the pool equipment is configured to maintain the wet probe while immersed in the swimming pool or spa and while removed from the swimming pool or spa.

Y. The pool equipment according to any previous or subsequent statement or combination of statements, wherein the pool equipment comprises an APC with a body, at least one motive element, and a pump.

Z. The pool equipment according to any previous or subsequent statement or combination of statements, wherein the APC comprises a sealable cavity, and wherein the wet probe is within the sealable cavity.

AA. The pool equipment according to any previous or subsequent statement or combination of statements, wherein the sealable cavity is in fluid communication with the pump.

BB. The pool equipment according to any previous or subsequent statement or combination of statements, wherein the pool equipment comprises an APC with a body, at least one motive element, and a sealable cavity, wherein the probe is within the sealable cavity, and wherein the sealable cavity is detachable from the body.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention. Further, although applicant has described devices and techniques for use principally with APCs, persons skilled in the relevant field will recognize that the present invention conceivably could be employed in connection with other objects and in other manners. Finally, references to "pools" and "swimming pools" herein may also refer to spas or other water containing vessels used for recreation, training, or therapy and for which cleaning of debris is needed or desired.

That which is claimed:

1. An automatic swimming pool cleaner (APC) for a swimming pool or spa, the APC comprising a sealable cavity configured to seal and maintain water within the cavity when the APC is removed from the swimming pool or spa.

2. The APC of claim 1, further comprising a water sensing probe within the cavity.

3. The APC of claim 1, further comprising a water treatment feature within the cavity.

4. The APC of claim 3, wherein the water treatment feature comprises a chemical tablet.

5. The APC of claim 1, wherein the cavity is within a body cavity defined by a body of the APC or outside of the body cavity.

6. The APC of claim 1, wherein the cavity is self-sealing.

7. The APC of claim 1, wherein the cavity is detachable from a body of the APC.

8. Pool equipment for a swimming pool or spa, the pool equipment comprising a sealable cavity configured to (i) allow a flow of water through the cavity and (ii) maintain the cavity with water when the flow of water is disrupted or halted.

9. The pool equipment of claim 8, wherein the pool equipment comprises a heater pump or an automatic swimming pool cleaner (APC).

10. The pool equipment of claim 8, wherein the sealable cavity is within a body cavity defined by a body of the pool equipment or outside of the body cavity.

11. The pool equipment of claim 10, wherein the pool equipment comprises an APC, wherein the sealable cavity is configured to allow the flow of water through the cavity when the APC is immersed in the swimming pool or spa and to maintain the cavity with water when the APC is removed from the swimming pool or spa.

12. The pool equipment of claim 10, wherein the pool equipment comprises an APC, wherein the APC comprises a pump, and wherein the sealable cavity is in fluid communication with the pump.

13. The pool equipment of claim 8, wherein the sealable cavity comprises an inlet and an outlet, and wherein the pool equipment further comprises a check valve for at least one of the inlet or the outlet.

14. The pool equipment of claim 8, further comprising a probe or a water treatment feature within the cavity.

15. Pool equipment for a swimming pool or spa, the pool equipment configured to maintain a probe in water such that the probe is a wet probe when a flow of water through the pool equipment is disrupted or halted, wherein the pool equipment comprises an automatic swimming pool cleaner (APC) with a body, at least one motive element, and a pump, wherein the APC comprises a sealable cavity, and wherein the wet probe is within the sealable cavity.

16. The pool equipment of claim 15, wherein the pool equipment is configured to maintain the wet probe while immersed in the swimming pool or spa and while removed from the swimming pool or spa.

17. The pool equipment of claim 15, wherein the sealable cavity is in fluid communication with the pump.

18. Pool equipment for a swimming pool or spa, the pool equipment configured to maintain a probe in water such that the probe is a wet probe when a flow of water through the pool equipment is disrupted or halted, wherein the pool equipment comprises an automatic swimming pool cleaner (APC) with a body, at least one motive element, and a sealable cavity, wherein the probe is within the sealable cavity, and wherein the sealable cavity is detachable from the body.

* * * * *